US009180711B2

(12) United States Patent
Kondo et al.

(10) Patent No.: US 9,180,711 B2
(45) Date of Patent: Nov. 10, 2015

(54) LIQUID EJECTING APPARATUS

(71) Applicant: SEIKO EPSON CORPORATION, Tokyo (JP)

(72) Inventors: Katsuyuki Kondo, Shiojiri (JP); Satoshi Kawamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 50 days.

(21) Appl. No.: 13/782,207

(22) Filed: Mar. 1, 2013

(65) Prior Publication Data

US 2013/0229456 A1 Sep. 5, 2013

(30) Foreign Application Priority Data

Mar. 2, 2012 (JP) ..... 2012-046262

(51) Int. Cl.
*B41J 29/393* (2006.01)
*B41J 2/175* (2006.01)

(52) U.S. Cl.
CPC ..... *B41J 29/393* (2013.01); *B41J 2/1752* (2013.01); *B41J 2/17546* (2013.01)

(58) Field of Classification Search
CPC .... B41J 29/393; B41J 2/17546; B41J 2/0458; B41J 2/0451; B41J 2/2135
USPC ..... 347/19
See application file for complete search history.

(56) References Cited

U.S. PATENT DOCUMENTS

| | | | | |
|---|---|---|---|---|
| 5,997,121 | A * | 12/1999 | Altfather et al. | 347/7 |
| 2007/0076079 | A1 * | 4/2007 | Miura | 347/102 |
| 2009/0122092 | A1 * | 5/2009 | Hatasa et al. | 347/7 |
| 2010/0206871 | A1 * | 8/2010 | Kataoka et al. | 219/622 |

FOREIGN PATENT DOCUMENTS

| | | | | |
|---|---|---|---|---|
| JP | 11-138854 | | 5/1999 | |
| JP | 1999-138854 | * | 5/1999 | B41J 2/175 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A liquid ejecting apparatus includes a carriage that reciprocates and includes a recording head that ejects liquid and a liquid container that supplies the liquid to the recording head and an optical sensor that includes a light emitting section capable of emitting light toward the carriage and a light receiving section that receives reflected light that is light that has been emitted from the light emitting section and has been reflected by the liquid container. The carriage is provided with a projecting section capable of suppressing incidence of ambient light to the light receiving section of the optical sensor.

5 Claims, 8 Drawing Sheets

LIQUID EJECTING APPARATUS

BACKGROUND

1. Technical Field

The present invention relates to a liquid ejecting apparatus that includes an optical detector.

2. Related Art

In general, recording apparatuses that are liquid ejecting apparatuses and that perform recording processes such as printing on a recording medium such as a sheet that is transported are known. An example of recording apparatuses is an ink jet printer, and this type of printer usually performs printing using ink supplied from an ink cartridge that is removably mounted thereon, and thus, the printer includes means for checking whether the ink cartridge is appropriately mounted or not in order to avoid performing printing without the ink cartridge mounted thereon.

For example, JP-A-11-138854 describes a printer that includes an optical sensor that has a light emitting section and a light receiving section and is provided at a predetermined position on a movement path of a carriage that reciprocates in a main scanning direction with ink cartridges mounted on the carriage. This printer is configured so that, only when the ink cartridges are appropriately mounted on the carriage, does the light emitting section emit light toward the carriage that passes above a location where the optical sensor is provided, and after that, the light receiving section detects reflected light that is light that has been reflected by an outer wall of one of the ink cartridges. In other words, the optical sensor determines whether the ink cartridges are appropriately mounted or not by the presence of reflected light detected by the light receiving section.

In the case where a printer including an optical sensor is disposed near a window or a light source, there has been a problem in that when the printer is used, ambient light such as sunlight or illumination light enters a light receiving section of the optical sensor from a space between a main body cover and a frame, causing detection failure. A main cause of this is that a space is formed between a carriage that reciprocates in a main scanning direction and an optical sensor that is arranged and fixed below the carriage in order to prevent a contact between the carriage and the optical sensor, and strong ambient light enters the optical sensor from the space.

In the printer described in JP-A-11-138854, projecting sections are provided at the periphery of the optical sensor as light blocking walls so as not to allow ambient light to enter the optical sensor. With this configuration, the ambient light can be prevented from directly entering the optical sensor, but cannot be prevented from entering the periphery of the optical sensor. Therefore, with the above-described configuration, there is a possibility that the ambient light reflected at the periphery of the optical sensor enters the optical sensor resulting in detection failure of the optical sensor. Thus, the configuration is not sufficient as a measure for preventing incidence of ambient light.

SUMMARY

An advantage of some aspects of the invention is that it provides a liquid ejecting apparatus in which optical detection is performed by an optical detector, and in which false detection of the optical detector due to ambient light can be suppressed.

A liquid ejecting apparatus according to an aspect of the invention includes an apparatus main body, a guide provided on the apparatus main body, a carriage that reciprocates by being guided by the guide and includes a liquid ejecting head that ejects liquid and a liquid container that contains the liquid to be supplied to the liquid ejecting head, and an optical detector that is positioned below the carriage in a movement area of the carriage and that includes a light emitting section capable of emitting light toward the liquid container of the carriage and a light receiving section that receives reflected light that is light that has been emitted from the light emitting section and has been reflected by the liquid container. A space is formed between an edge of the carriage and a member of the apparatus main body facing the movement area, and a projecting section that suppresses incidence of ambient light to an area between the space and the optical detector is formed on the carriage.

Even if ambient light is likely to enter from the space between the edge of the carriage and the member of the apparatus main body facing the movement area of the carriage, the ambient light is prevented from directly entering the optical detector and also directly entering the periphery of the optical detector because the projecting section, which suppresses incidence of the ambient light, is formed on the carriage. Therefore, in a liquid ejecting apparatus in which optical detection is performed by an optical detector, false detection of the optical detector due to ambient light can be suppressed.

In the liquid ejecting apparatus according to the aspect of the invention, the optical detector may include a wall section projecting toward the carriage beyond a portion surrounding the optical detector.

According to the above-described configuration, even if ambient light that has entered from the space between the edge of the carriage and the member of the apparatus main body facing the movement area of the carriage reaches the periphery of the optical detector after being reflected several times, the ambient light can be additionally reflected because the optical detector has the wall section projecting toward the carriage beyond the periphery of the optical detector, and as a result, only limited light can reach the optical detector.

The liquid ejecting apparatus according to the aspect of the invention further includes a frame that is arranged so as to extend along the movement direction of the carriage, and the projecting section and the frame are superposed with each other in a direction perpendicular to the movement direction of the carriage.

According to the above-described configuration, ambient light that enters from the direction perpendicular to the movement direction of the carriage can be effectively blocked because the projecting section and the frame are superposed with each other in the direction perpendicular to the movement direction of the carriage, and as a result, only limited light can directly reach the optical detector.

In the liquid ejecting apparatus according to the aspect of the invention, the projecting section may be colored with a light absorbing color.

According to the above-described configuration, when ambient light enters a space between the carriage and the optical detector, the ambient light will not penetrate the projecting section formed on the carriage and will not be reflected by the projecting section, and thus, the ambient light is not likely to reach the light receiving section of the optical detector compared to the case where the projecting section is colored with a color that is likely to reflect light such as a white color.

In the liquid ejecting apparatus according to the aspect of the invention, the portion surrounding the optical detector may be colored with a light absorbing color.

According to the above-described configuration, even if ambient light reaches the portion surrounding the optical detector, the surrounding portion absorbs the ambient light, so that the light intensity of the ambient light can be reduced before the ambient light reaches the light receiving section.

In the liquid ejecting apparatus according to the aspect of the invention, the projecting section is arranged in a projecting manner in a direction that crosses the direction from the carriage to the optical detector.

According to the above-described configuration, even if the space between the optical detector and the carriage is narrow, the projecting section can be arranged in a projecting manner so as to have a roof-like shape and an arbitrary length from a position outside of the space, and thus, sufficient measures for preventing incidence of ambient light can be taken.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention in which the invention is embodied as an ink jet printer that is a type of a recording apparatus (hereinafter simply referred to as a printer) will now be described below with reference to FIG. 1 to FIG. 8.

Figure 1:
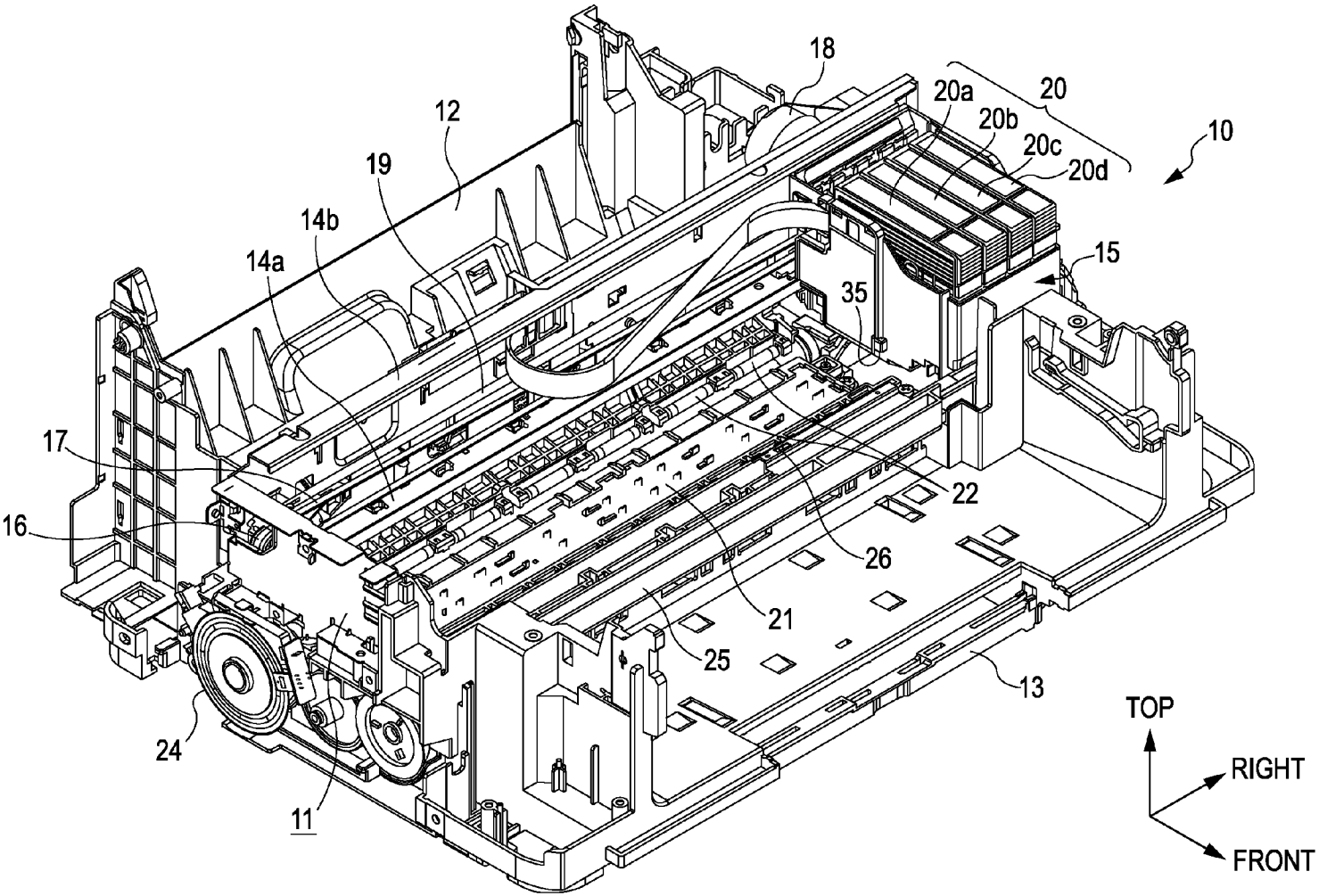
FIG. 1 is a general perspective view of a printer according to an embodiment of the invention.

As shown in FIG. 1, in a printer 10 of the present embodiment, a sheet feed tray 12 in which a plurality of sheets P can be inserted and set is provided on the back side of a main body frame 11 (an apparatus main body). The main body frame 11 has a generally square box shape, and the back side and front side of the main body frame 11 are open. The printer 10 performs printing on the sheets P fed from the sheet feed tray 12 sheet by sheet and ejects the printed sheets P on a sliding sheet ejection tray 13 that is provided at the lower front position of the main body frame 11.

Guide rails 14*a* and 14*b* having a predetermined length are installed on the back surface of the main body frame 11, and a carriage 15 is provided so as to be capable of reciprocating in a main scanning direction (the left-right direction) along the guide rails 14*a* and 14*b*. The carriage 15 is fixed to an endless timing belt 17 that is wound around a pair of pulleys 16 attached to an inner surface of a back plate of the main body frame 11. Therefore, a carriage motor 18 that is an example of a driver and that has a drive shaft attached to one of the pulleys on the right side in FIG. 1 (not shown) is driven in both forward and reverse directions, so that the timing belt 17 rotates in forward and reverse directions, and as a result, the carriage 15 reciprocates in the main scanning direction (the left-right direction).

A linear encoder 19 that outputs pulses in a number proportional to a travel distance of the carriage 15 is provided on the back surface of the carriage 15 so as to extend along the guide rail 14*a* in the left-right direction.

An ink jet recording head 35 that is an example of a liquid ejecting head is provided in a lower portion of the carriage 15. A plurality of nozzles (not shown) that eject ink that is an example of a liquid are open in the bottom surface of the recording head 35. A plurality of ink cartridges 20 (20*a* to 20*d*) are loaded into an upper portion of the carriage 15. The ink cartridges 20 are liquid containers that contain liquid (ink), and inks of four colors such as, for example, black (K), cyan (C), magenta (M), and yellow (Y) are contained in the respective ink cartridges 20. The recording head 35 ejects the inks supplied by the ink cartridges 20 by using the nozzles in accordance with the colors of the inks.

A support 21 that defines a distance (a gap) between the recording head 35 and one of the sheets P is provided at a low position in the main body frame 11 such that the support 21 faces the recording head 35 in a main scanning area in which the carriage 15 reciprocates. The support 21 extends, in a width direction (the left-right direction), over a range including a printing area in which ink jet printing is performed by the recording head 35. During printing, ink ejected from the recording head 35 lands on a portion of the sheet P that is on the support 21.

Transport rollers 22 and ejection rollers 23 (see FIG. 4) for transporting the sheet P are provided on the upstream side and the downstream side of the support 21 in a transport direction of the sheet P (the forward direction), respectively. The transport rollers 22 and ejection rollers 23 transport the sheet P to the sheet ejection tray 13 by being driven by a drive motor 24 so as to rotate. The transport rollers 22 are arranged in the main body frame 11, and the ejection rollers 23 are arranged in a sheet ejection frame 25 (a frame) that is installed on the downstream side of the support 21 and extends in the main body frame 11 in the left-right direction. The sheet ejection frame 25 is positioned so as to face a movement area of the carriage 15.

An optical sensor 26 that detects the remaining amount of ink in each of the ink cartridges 20 is embedded, as an example of an optical detector, in a position on the top surface side of the sheet ejection frame 25 and slightly to the right from the center of the sheet ejection frame 25. The optical sensor 26 includes a light emitting section 26*a* that emits light and a light receiving section 26*b* that receives light (see FIGS. 3, 6, and 8). A portion of the sheet ejection frame 25 surrounding a position in which the optical sensor 26 is embedded is colored with a black color that is an example of a light absorbing color so as not to reflect ambient light. The optical sensor 26 also includes a wall section 100 projecting toward the carriage 15 beyond the portion surrounding the optical sensor 26. Therefore, ambient light that has entered the periphery of the optical sensor 26 can be additionally reflected by the wall section 100, and the influence of the ambient light can be reduced through the process.

As described above, the printer 10 prints text or images on the sheet P by alternately repeating a printing operation in which ink is ejected to the sheet P from the nozzles of the recording head 35 while the carriage 15 reciprocates in the main scanning direction (the left-right direction) and a feed operation in which the sheet P is transported in a subscanning direction (the forward direction) by a predetermined transportation amount.

Figure 2:
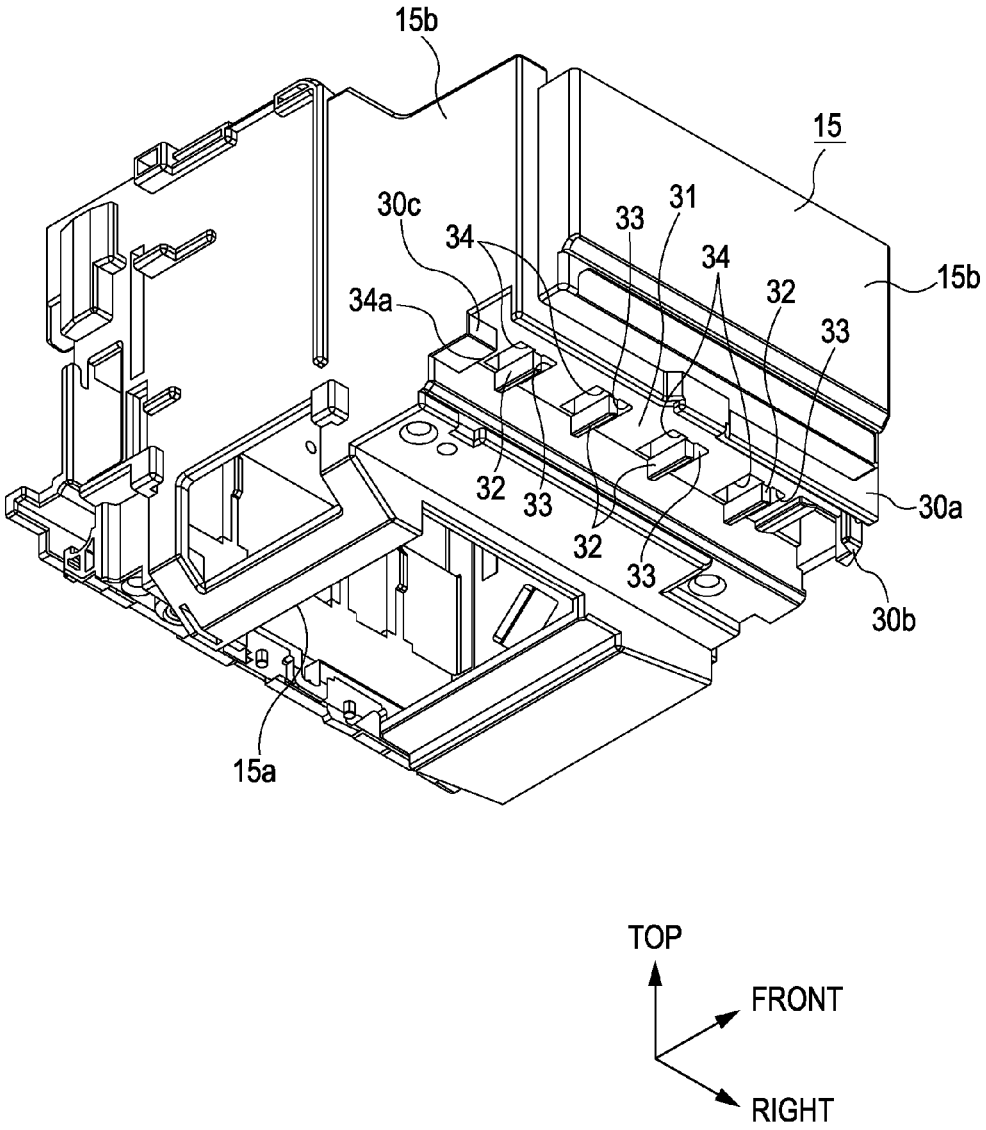
FIG. 2 is a perspective view of a carriage as viewed from lower left.

As shown in FIG. 2, the carriage 15 is formed into a generally square box shape and has an open top. A mount opening 15*a* in which the recording head 35 is to be mounted and held is formed in the lowermost surface of the carriage 15. Light blocking walls (projecting sections) 30*a* to 30*c* are arranged in a projecting manner on ends of a bottom surface portion of the carriage 15 on the front side, that is, a surface area that forms a space between the carriage 15 and the optical sensor 26 and that faces the optical sensor 26, in order to prevent incidence of light to the space from the front, right, and left sides. More specifically, a front light blocking wall 30*a*, a right light blocking wall 30*b*, and a left light blocking wall 30*c* are arranged in a projecting manner, and an area 31 in which detection of the remaining amount of ink is performed surrounded by the light blocking walls 30*a* to 30*c* is formed on the bottom surface side of the carriage 15.

Light dividing ribs 32, the number of which corresponds to the number of the ink cartridges 20 are provided in the area 31 in which detection of the remaining amount of ink is performed. An incident light path 33 through which light emitted from the light emitting section 26*a* for measuring the remaining amount of the ink passes and a reflected light path 34 through which light reflected by the corresponding ink cartridge 20 passes are drilled in both sides of each light dividing rib 32. The area 31 in which detection of the remaining amount of ink is performed and the light blocking walls 30*a* to 30*c* are colored with a black color (a light absorbing color) that is most likely to absorb light for the purpose of not reflecting light that enters the area 31 in which detection of the remaining amount of ink is performed.

Figure 3:
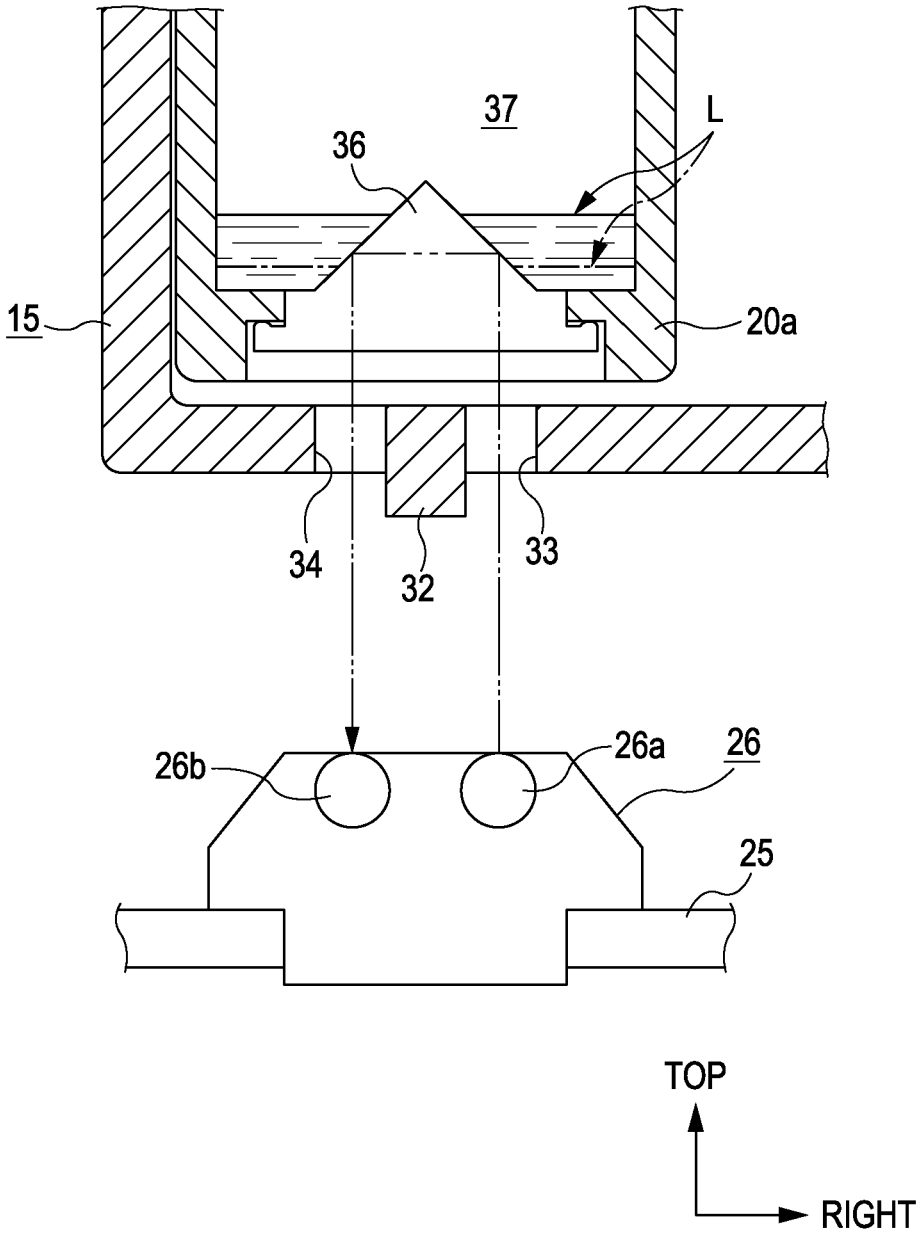
FIG. 3 is a sectional view explaining the outline of a system for detecting the remaining amount of ink.
Figure 4:
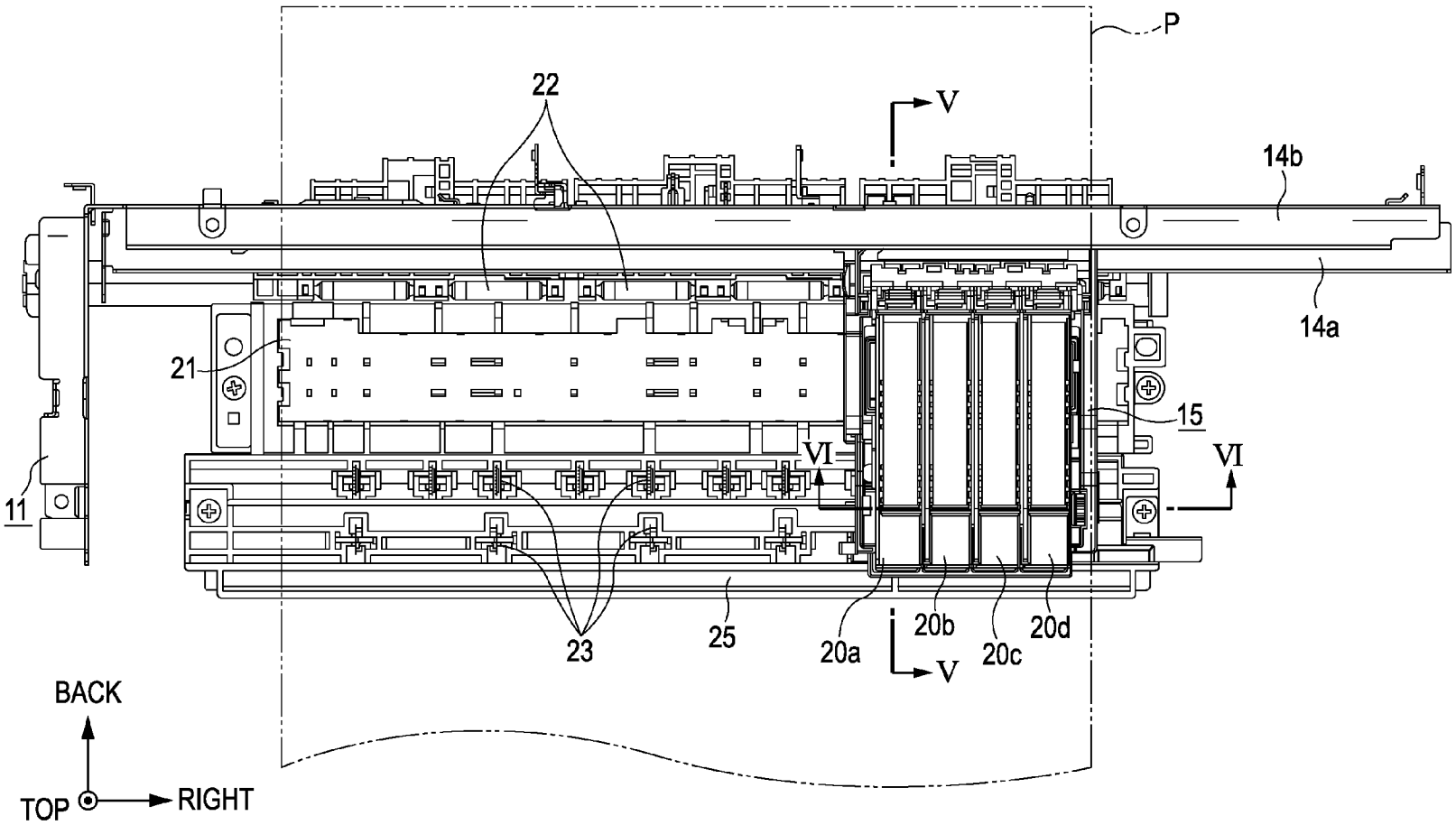
FIG. 4 is a partial plan view of the printer.

Next, the principle of a system for detecting the remaining amount of ink according to the present embodiment will be described with reference to FIG. 3. FIG. 3 schematically shows a state of the optical sensor 26 when the optical sensor 26 detects the remaining amount of the ink in the ink cartridge 20*a* of the plurality of ink cartridges 20 (20*a* to 20*d*), and the light blocking walls 30*a* to 30*c* that block ambient light are not shown in the figure.

As shown in FIG. 3, the optical sensor 26 including the light emitting section 26*a* and the light receiving section 26*b* is arranged in the sheet ejection frame 25 located on the lower side of the movement area of the carriage 15. The carriage 15 is arranged so that the incident light path 33 and the reflected light path 34 formed in the carriage 15 are in line with the light emitting section 26*a* and the light receiving section 26*b*, respectively, in the vertical direction. The ink cartridge 20*a* that is mounted on the carriage 15 has walls, and one of the walls that is a bottom wall when the ink cartridge 20*a* is mounted on the carriage 15 as shown in FIG. 3 is partly formed of a prism 36 that is in the form of a right triangle wedge. An ink chamber 37 that is an example of a liquid container and that contains ink with inclined surfaces of the prism 36 that intersect at right angles and the walls of the ink cartridge 20*a* is formed in the ink cartridge 20*a*.

In the case where a liquid surface of the ink in the ink chamber 37 is an ink liquid surface L indicated by a solid line in FIG. 3, and a sufficient amount of the ink remains in the ink chamber 37, the light emitted from the light emitting section 26*a* will not be reflected by the prism 36 and will be refracted in the ink chamber 37. On the other hand, in the case where the remaining amount of the ink in the ink chamber 37 decreases, and the ink liquid surface L comes down to the position of an ink liquid surface L indicated by a one dot chain line in FIG. 3, the light emitted from the light emitting section 26*a* will be reflected in the prism 36, and the reflected light will enter the light receiving section 26*b*. Thus, the optical sensor 26 detects the remaining amount of the ink by detecting reflected light that is light radiated onto the prism 36 and reflected by the prism 36, which is formed on the bottom surface of the ink cartridge 20*a*, with the light receiving section 26*b*.

As described above, a method of detecting the remaining amount of ink by detecting the reflected light with the light receiving section 26*b* is employed in the detection system for detecting the remaining amount of ink according to the present embodiment. Therefore, if ambient light enters the light receiving section 26*b*, the light receiving section 26*b* falsely recognizes the ambient light as the light reflected by the prism 36, and this leads to detection failure in which it is determined that there is no ink in the ink cartridges 20 whereas there is a sufficient amount of ink in the ink cartridges 20.

Next, operation of the printer 10 configured as described above will be described with reference to FIG. 4 to FIG. 8. As described above, the optical sensor 26 is arranged in a position above the sheet P that is transported in the transport direction and below the carriage 15 that reciprocates in the main scanning direction, and thus, the remaining amount of ink in each of the ink cartridges 20 that sequentially changes during printing can be detected. In the present embodiment, the remaining amount of ink in each of the ink cartridges 20 that are mounted on the carriage 15 is detected in every pass for the purpose of improving reliability in detecting the remaining amount of ink.

The remaining amount of ink is detected in a return process of the carriage 15 that reciprocates in the main scanning direction. In other words, the remaining amounts of the inks in the ink cartridges 20 are detected in order starting from that of the ink cartridge 20*d* that is mounted on the right end of the carriage 15 toward that of the ink cartridge 20*a* that is mounted on the left end of the carriage 15. The remaining amount of the ink is detected when the light emitting section 26*a* and the light receiving section 26*b* of the optical sensor 26 are in line with the incident light path 33 and the reflected light path 34 provided in each of the ink cartridges 20 (20*a* to 20*d*), respectively. Detection of the remaining amount of ink in one pass will be completed by repeating this detection operation as many times as the number of the ink cartridges 20 that are mounted on the carriage 15.

Next, the influence of ambient light when detecting the remaining amount of ink will be described.

In the present embodiment, the optical sensor 26 is located substantially at the center of the sheet ejection frame 25 in the main scanning direction (the left-right direction), and thus, the influence of ambient light that enters from the front, right, and left sides of the printer 10 needs to be considered. In the present embodiment, the ink cartridges 20*a* to 20*d* of four colors are mounted on the carriage 15, and especially when the remaining amount of ink in the ink cartridges 20*a* and 20*d* that are mounted on the left and right ends of the carriage 15, respectively, is detected, the influence of the ambient light increases due to the ambient light that enters from the right and left sides. The influence of the ambient light that enters from the front side is the same in all cases where the remaining amount of ink in any one of the ink cartridges 20*a* to 20*d* is detected.

Figure 7:
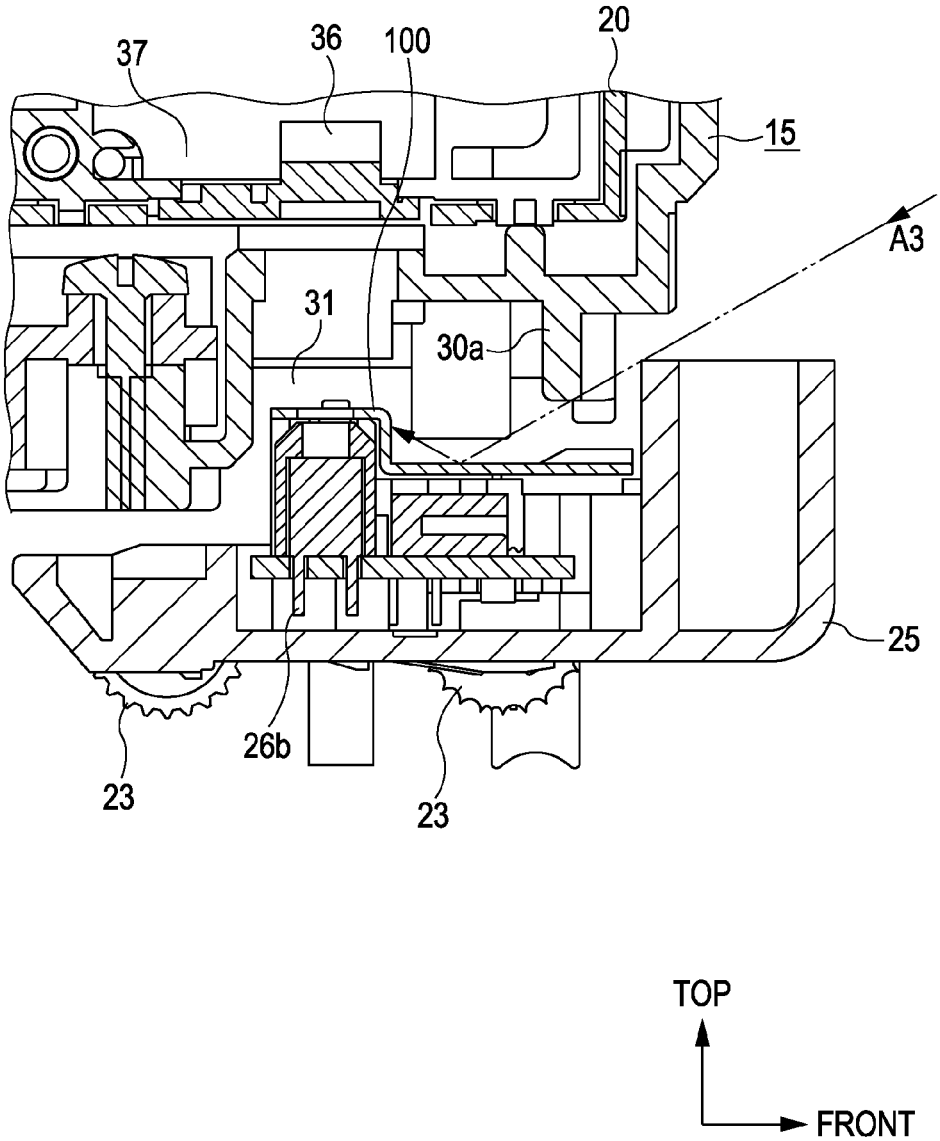
FIG. 7 is an enlarged view of a portion of FIG. 5.
Figure 8:
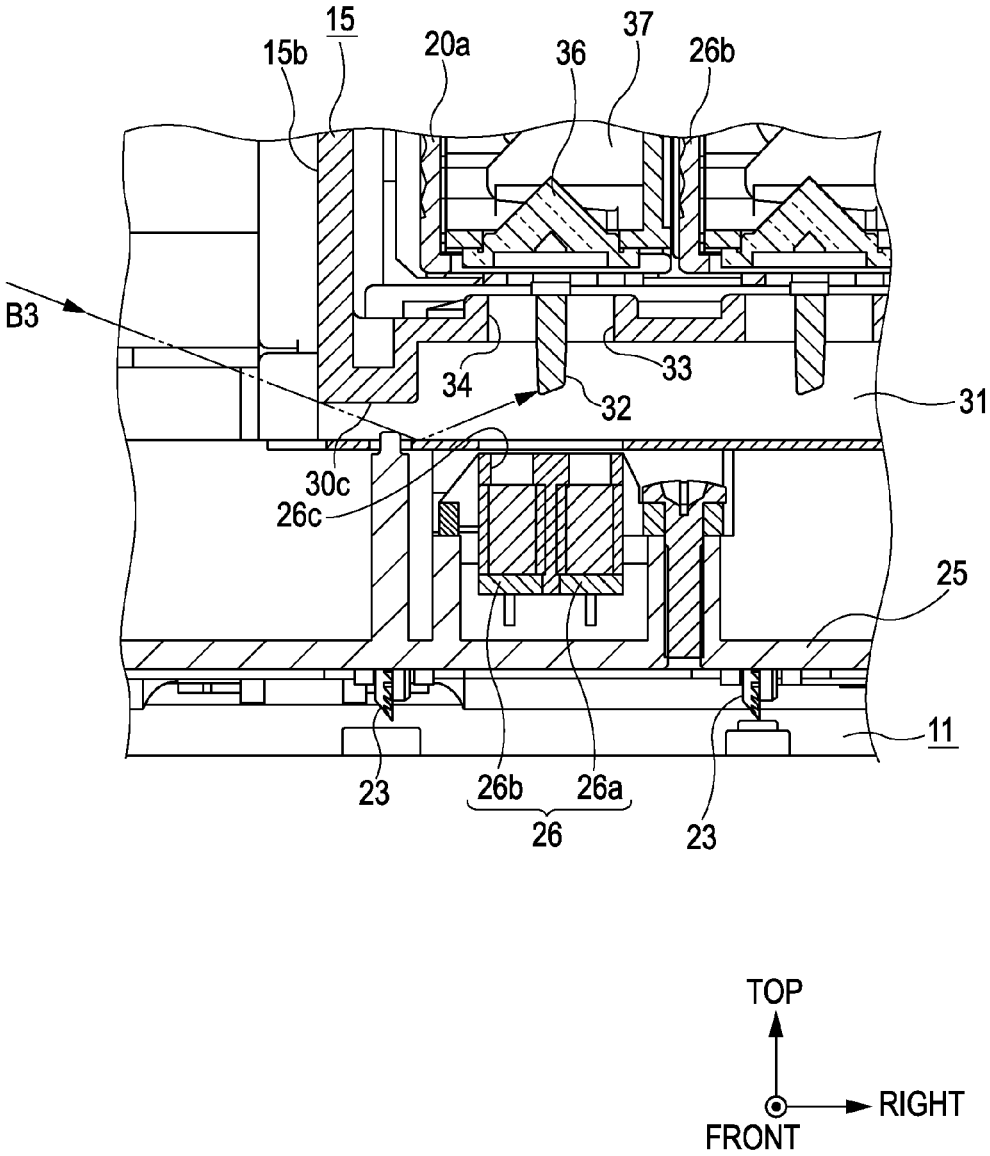
FIG. 8 is an enlarged view of a portion of FIG. 6.

The influence of the ambient light that enters from the front side when detecting the remaining amount of ink in any one of the ink cartridges 20 will be described with reference to FIG. 5 and FIG. 7, and the influence of the ambient light that enters from the left side when detecting the remaining amount of ink in the ink cartridge 20*a* that is mounted on the left end of the carriage 15 will be described with reference to FIG. 6 and FIG. 8. Since the influence of the ambient light that enters from the right side when detecting the remaining amount of the ink in the ink cartridge 20*d*, which is mounted on the right end of the carriage 15, is substantially the same as the influence of the ambient light that enters from the left side when detecting the remaining amount of the ink in the ink cartridge

20*a*, which is mounted on the left end of the carriage 15, repeated descriptions will be avoided.

Figure 5:
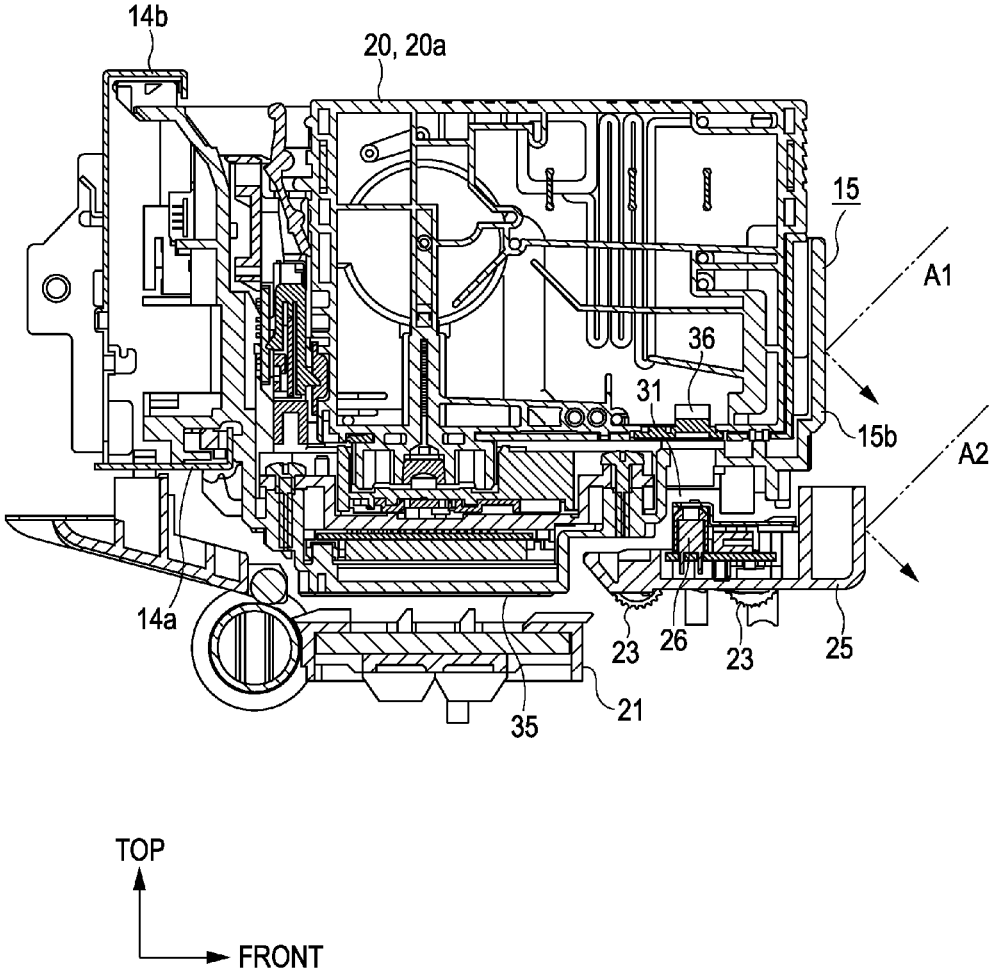
FIG. 5 is a sectional view taken along line V-V of FIG. 4.
Figure 6:
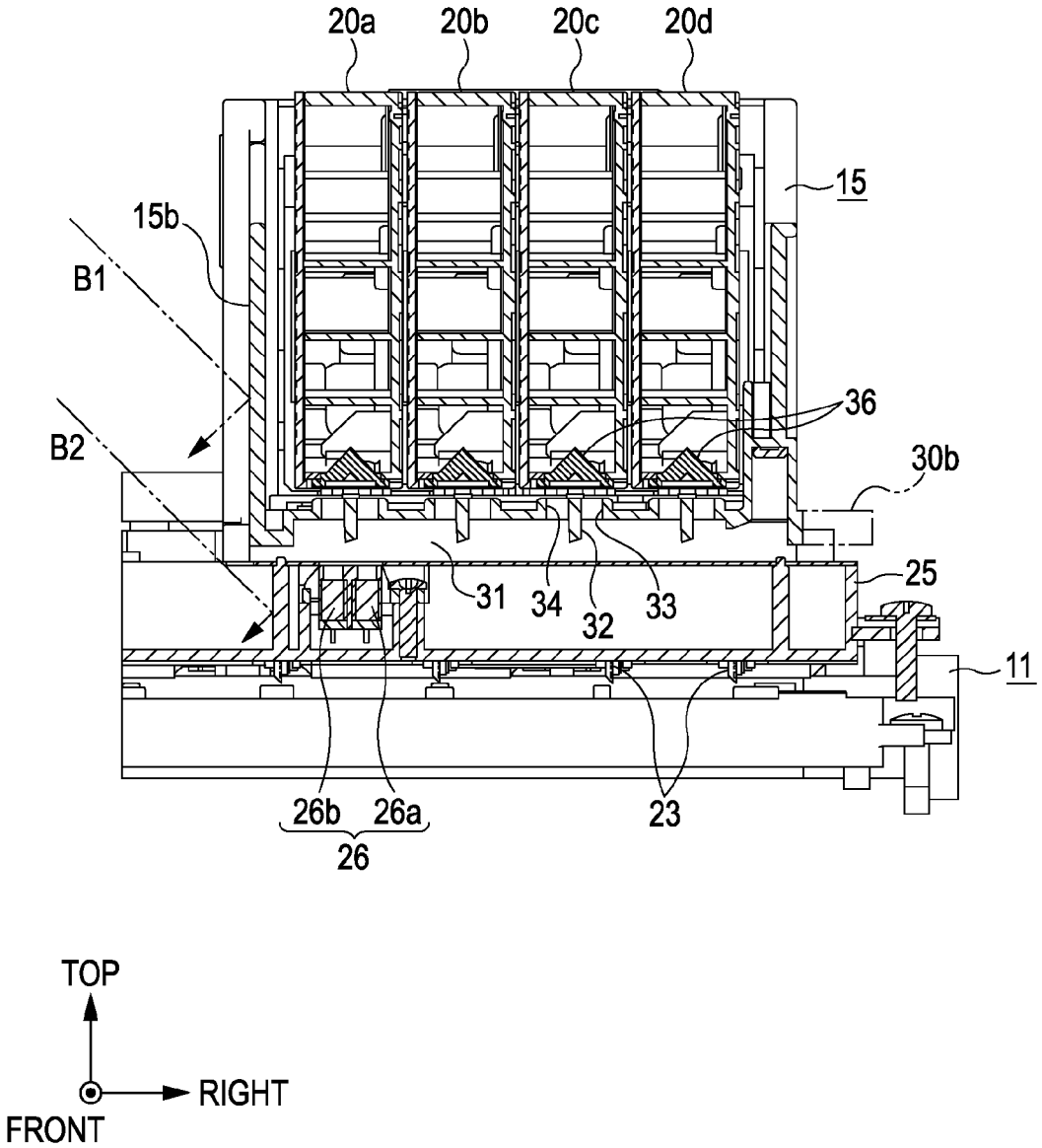
FIG. 6 is a sectional view taken along line VI-VI of FIG. 4.

Among ambient lights A1 to A3 and B1 to B3 that are likely to enter the optical sensor 26 from various directions, most of them including the ambient lights A1, A2, B1, and B2 are blocked by a wall surface 15*b* of the carriage 15 and the sheet ejection frame 25 and will not enter the area 31 in which detection of the remaining amount of ink is performed as indicated by two-dot chain lines in FIG. 5 and FIG. 6. As indicated by a two-dot chain line in FIG. 7, the ambient light A3 enters from a space formed between the sheet ejection frame 25 that is a portion of the apparatus main body facing the movement area of the carriage 15 and an edge of the carriage 15. However, the front light blocking wall 30*a* as a projecting section that suppresses incidence of the ambient light A3 from the space is formed on the carriage 15 in an area between the space and the optical sensor 26, and thus, the ambient light A3 is prevented from directly entering the optical sensor 26 and also from directly entering the periphery of the optical sensor 26. Therefore, although the ambient light A3 enters the area 31 in which detection of the remaining amount of ink is performed, it will not enter the light receiving section 26*b* of the optical sensor 26 and an opening 26*c* in which the light receiving section 26*b* is embedded. In particular, as shown in FIG. 7, the front light blocking wall 30*a* and the sheet ejection frame 25 are superposed with each other in a height direction (a direction perpendicular to the main scanning direction of the carriage 15), and thus, the ambient light that enters from the front side will be effectively blocked. The left light blocking wall 30*c* functions in the same way as the front light blocking wall 30*a* does.

Even if the ambient lights A3 and B3 that enter the area 31 in which detection of the remaining amount of ink is performed are reflected once in the area 31 in which detection of the remaining amount of ink is performed, the ambient lights A3 and B3, which are reflected once, will not enter the light receiving section 26*b*. There is a possibility that ambient light that is reflected more than once may reach the light receiving section 26*b*. However, in this case, the ambient light will be absorbed by wall surfaces that are colored with a black color, which is a light absorbing color, and surrounding the area 31 in which detection of the remaining amount of ink is performed through a process in which the ambient light is reflected more than once. Thus, even if the ambient light enters the light receiving section 26*b*, it will not affect detection performed by the optical sensor 26 because the light intensity of the ambient light has been decreased. Therefore, even if the ambient light enters the printer 10, the optical sensor 26 can detect the remaining amount of ink in the ink cartridges 20 without being affected by the ambient light.

As described in detail above, the present embodiment can provide the following advantages.

1. Since the front light blocking wall 30*a* that suppresses incidence of ambient light is formed on the carriage 15, even if ambient light is likely to enter from the space between the edge of the carriage 15 and the portion of the apparatus main body facing the movement area of the carriage 15, the ambient light is prevented from directly entering the optical sensor 26 and also from directly entering the periphery of the optical sensor 26. Therefore, in the printer 10 in which optical detection is performed by the optical sensor 26, false detection of the optical sensor 26 due to the influence of ambient light can be suppressed.

2. Even if the ambient light that has entered from the space between the edge of the carriage 15 and the portion of the apparatus main body facing the movement area of the carriage 15 reaches the periphery of the optical sensor 26 after being reflected several times, the ambient light can be additionally reflected because the optical sensor 26 has a wall section 100 projecting toward the carriage 15 beyond the periphery of the optical sensor 26, and as a result, only limited light can reach the optical sensor 26.

3. Since the front light blocking wall 30*a* and the sheet ejection frame 25 are superposed with each other in the height direction that is perpendicular to the main scanning direction of the carriage 15, ambient light that enters from the direction perpendicular to the main scanning direction of the carriage 15 can be effectively blocked, and only limited light can directly reach the optical sensor 26. In particular, the front light blocking wall 30*a* that is formed on the front end of the carriage 15 and the sheet ejection frame 25 are superposed with each other in the height direction, and thus, the ambient lights A1 to A3 from the front of the printer 10 can be effectively blocked.

4. Since the light blocking walls 30*a* to 30*c* are colored with a black color, which is a light absorbing color, when ambient light enters the space between the carriage 15 and the optical sensor 26, the ambient light will not penetrate the light blocking walls 30*a* to 30*c* formed on the carriage 15 and will not be reflected by the light blocking walls 30*a* to 30*c*, and thus, the ambient light is not likely to reach the light receiving section 26*b* of the optical sensor 26 compared to the case where the light blocking walls 30*a* to 30*c* are colored with a color that is likely to reflect light such as a white color.

5. Since the portion of the main body frame 11 surrounding the position at which the optical sensor 26 is arranged is colored with a black color, which is a light absorbing color, if ambient light reaches the portion surrounding the optical sensor 26 from a space between the carriage 15 and the main body frame 11, the surrounding portion absorbs the ambient light, so that the light intensity of the ambient light can be reduced before the ambient light reaches the light receiving section 26*b*.

6. Variation in the remaining amount of ink in relation to the use of the printer 10 can be determined in detail by detecting the remaining amount of ink in every pass when the carriage 15 reciprocates, and reliability in detecting the remaining amount of ink can be improved.

Note that the above-described embodiment may be changed as follows.

In the above-described embodiment, when the prism 36 forming a part of the wall surface of the ink chamber 37 is formed on the front or back surface of the carriage 15, the optical sensor 26 may be arranged so as to emit light toward the front or back surface of the carriage 15.

In the above-described embodiment, the light absorbing color used for coloring the area 31 in which detection of the remaining amount of ink is performed and the like need not be a black color, and any other color that is highly absorbent for a wavelength of light that is to be detected by the optical sensor 26 can be used.

In the above-described embodiment, the remaining amount of ink may be detected not in every pass but once in several passes. The optical sensor 26 may be arranged so as to measure time and detect the remaining amount of ink every time a predetermined time passes.

In the above-described embodiment, for example, as indicated by two-dot chain lines in FIG. 6, the projecting direction of the light blocking walls 30*a* to 30*c* (the right light blocking wall 30*b* in FIG. 6) may be a direction that crosses the direction from the carriage 15 to the optical sensor 26 (the horizontal direction in the same figure). In this case, even if the space between the optical sensor 26 and the carriage 15 is narrow, the light blocking walls can be arranged in a projecting manner so as to have a roof-like shape and an arbitrary length from positions outside of the space (side surfaces of the carriage 15), and thus, sufficient measures for preventing incidence of ambient light can be taken.

In the above-described embodiment, the optical sensor 26 may detect whether the ink cartridges 20 are mounted on the carriage 15 or not, whether their mounting postures are appropriate or not, and the like other than the remaining amount of ink.

In the above-described embodiment, the front light blocking wall 30*a* and the sheet ejection frame 25 may be superposed with each other in the transport direction of the sheet P that is perpendicular to the main scanning direction of the carriage 15. In other words, the direction in which the front light blocking wall 30*a* and the sheet ejection frame 25 are superposed with each other need not be the height direction and may be any other direction that is perpendicular to the main scanning direction, which is the movement direction of the carriage 15.

In the above-described embodiment, the invention is embodied as the printer 10 that ejects ink that is a type of liquid. However, the invention may be embodied as a liquid ejecting apparatus that ejects or discharges any liquid other than ink. The above-described embodiment is applicable to various types of liquid ejecting apparatuses that include a liquid ejecting head that discharges very small liquid droplets. Note that the term "liquid droplets" denote states of a liquid that is to be discharged by the above-described liquid ejecting apparatus, and the states include a state in which the liquid has a granular shape, a state in which the liquid has a teardrop shape, and a state in which the liquid is drawn out into a string. The liquid mentioned herein may be any material that can be ejected by the liquid ejecting apparatus. The material is not limited as long as the material is a substance that is in a liquid phase, and examples of the substance include liquids having a high or low viscosity, fluids such as sols, gel water, and other inorganic solvents, organic solvents, liquid solutions, liquid resins, and liquid metals (metallic melts). In addition to the liquid that is one of states of a substance, examples of the substance include particles of functional materials including solid materials such as pigment and metallic particle that are dissolved, dispersed or mixed into solvents. Representative examples of the liquid are ink such as that described in the above-described embodiment, liquid crystals, and the like. Examples of the ink described herein include various liquid compositions such as a common water-based ink, a common oil-based ink, a gel ink, a hot melt ink, and the like. A specific example of the liquid ejecting apparatus is a liquid ejecting apparatus that ejects liquid in which materials such as electrode materials and color materials that are used for manufacturing liquid crystal displays, electroluminescence (EL) displays, surface emitting displays, color filters, etc., are dispersed or dissolved. The liquid ejecting apparatus may also be a liquid ejecting apparatus that ejects living organic materials used for manufacturing biochips, a liquid ejecting apparatus used as a precise pipette that ejects a liquid to be a sample, a textile printing apparatus, a micro-dispenser, or the like. Furthermore, a liquid ejecting apparatus that targets portions of precision instruments such as clocks or cameras and ejects lubricating oil to the precision instruments, a liquid ejecting apparatus that ejects transparent resin liquid such as a UV curable resin to a substrate in order to form, for example, micro-hemispherical lenses (optical lenses) that are used in optical communication elements and the like, or a liquid ejecting apparatus that ejects an etching liquid that is acidic, alkaline or the like for etching a substrate or the like may be employed. The invention is applicable to any one type of these liquid ejecting apparatuses.

The entire disclosure of Japanese Patent Application No. 2012-046262, filed Mar. 2, 2012 is expressly incorporated by reference herein.

What is claimed is:

1. A liquid ejecting apparatus comprising:

an apparatus main body;

a guide rail that is provided on the apparatus main body;

a carriage that reciprocates by being guided by the guide rail and includes a liquid ejecting head that ejects liquid and a liquid container that contains the liquid to be supplied to the liquid ejecting head;

a transport roller that transports a recording medium to a printing area;

an ejection roller that transports the recording medium recorded by the liquid ejecting head in the printing area;

a recording medium ejection frame that is installed along the guide rail and arranges the ejection roller, the recording medium ejection frame is positioned to be lower than a part of a lower portion of the carriage, and has an area which overlaps with a movement area of the part of the lower portion of the carriage; and an optical detector that is positioned below to overlap with the movement area of the part of the lower portion of the carriage, the optical detector includes a light emitting section capable of emitting light toward the liquid container of the carriage and a light receiving section that receives reflected light that is light that has been emitted from the light emitting section and has been reflected by the liquid container, wherein the recording medium ejection frame has a first wall which projects upward at a position downstream, in a transport direction of the recording medium, than a position of the optical detector and a second wall which surrounds the optical detector, wherein the part of the lower portion of the carriage has a third wall which projects downward between the first wall and the second wall of the recording medium ejection frame, wherein the third wall of the carriage passes between the first wall and the second wall of the recording medium ejection frame according to the movement of the carriage.

2. The liquid ejecting apparatus according to claim 1, wherein the second wall of the recording medium ejection frame projects upward beyond the optical detector.

3. The liquid ejecting apparatus according to claim 1, wherein the projecting section and a portion between the projection portion and the optical detector are colored with a light absorbing color.

4. A liquid ejecting apparatus comprising:

an apparatus main body;

a guide rail that is provided on the apparatus main body;

a carriage that reciprocates by being guided by the guide rail and includes a liquid ejecting head that ejects liquid and a liquid container that contains the liquid to be supplied to the liquid ejecting head;

a transport roller that transports a recording medium to a printing area;

an ejection roller that transports the recording medium recorded by the liquid ejecting head in the printing area;

a recording medium ejection frame that is installed along the guide rail and arranges the ejection roller, the recording medium ejection frame is positioned to be lower than a part of a lower portion of the carriage, and has an area which overlapped with a movement area of the part of the lower portion of the carriage; and an optical detector that is positioned to overlap with the movement area of the part of the lower portion of the carriage, and includes a light emitting section capable of emitting light toward the liquid container of the carriage and a light receiving section that receives reflected light that is light that has been emitted from the light emitting section and has been reflected by the liquid container, wherein the recording medium ejection frame has a wall which projects upward at a position downstream, in a transport direction of the recording medium, a position of the optical detector, wherein the part of the lower portion of the carriage has a wall which projects downward between the wall of the recording medium ejection frame and the optical detector, wherein the wall of the carriage passes between the wall of the recording medium ejection frame and the optical detector according to the movement of the carriage.

5. The liquid ejecting apparatus according to claim 4, wherein the wall of the recording medium ejection frame and the wall of the carriage overlaps with each other in a height direction.

* * * * *